US012799724B2

(12) United States Patent
Roofeh

(10) Patent No.: US 12,799,724 B2
(45) Date of Patent: Nov. 17, 2026

(54) DUAL-SINK ASSEMBLY AND METHOD OF MANUFACTURE

(71) Applicant: Farhad Roofeh, Stamford, CT (US)

(72) Inventor: Farhad Roofeh, Stamford, CT (US)

( * ) Notice: Subject to any disclaimer, the term of this patent is extended or adjusted under 35 U.S.C. 154(b) by 305 days.

(21) Appl. No.: 18/360,782

(22) Filed: Jul. 27, 2023

(65) Prior Publication Data

US 2024/0035264 A1 Feb. 1, 2024

Related U.S. Application Data

(60) Provisional application No. 63/393,424, filed on Jul. 29, 2022.

(51) Int. Cl.
*E03C 1/18* (2006.01)
*E03C 1/33* (2006.01)

(52) U.S. Cl.
CPC . *E03C 1/18* (2013.01); *E03C 1/33* (2013.01)

(58) Field of Classification Search
CPC ..... E03C 1/18; E03C 1/33
USPC ..... D23/284
See application file for complete search history.

(56) References Cited

U.S. PATENT DOCUMENTS 2,026,804 A * 1/1936 Sterling ..... E03C 1/18 4/642
2,026,952 A * 1/1936 Reed ..... E03C 1/18 D23/287
3,235,886 A * 2/1966 Scharmer ..... E03C 1/18 4/640
D298,163 S * 10/1988 Downs ..... D23/290
2004/0181870 A1* 9/2004 Bohacik ..... B21D 51/18 4/619
2008/0087778 A1* 4/2008 Sather ..... E03C 1/33 4/643
2019/0048568 A1* 2/2019 Chia ..... E03C 1/335
2021/0372107 A1* 12/2021 Brooks ..... E03C 1/33

FOREIGN PATENT DOCUMENTS

GB 2267639 A * 12/1993 ..... E03C 1/18

* cited by examiner

*Primary Examiner* — Christine J Skubinna
(74) *Attorney, Agent, or Firm* — Eversheds Sutherland (US) LLP

(57) ABSTRACT

Dual-sink assemblies for installation in diagonal corner cabinets and methods of manufacture are provided. A dual-sink assembly may include two sinks, attached by welding or otherwise, each having a length greater than a width. The length of one sink may be greater than that of the other sink. A diagonal corner cabinet may include a countertop, which may include a working edge and two rear edges, the two rear edges intersecting at a rear corner point. The dual-sink assembly may be installed in the diagonal corner cabinet with center points of the two sinks located along a transverse axis extending from the working edge toward the rear corner point of the diagonal corner cabinet and the sink having the greater length located closer to the working edge than the other sink. Accordingly, the dual-sink assembly may provide two sinks within the diagonal corner cabinet, while optimizing use of countertop space.

16 Claims, 8 Drawing Sheets

DUAL-SINK ASSEMBLY AND METHOD OF MANUFACTURE

CROSS-REFERENCE TO RELATED APPLICATION

This application is related to, and claims the benefit of, U.S. Provisional Patent Application No. 63/393,424, filed Jul. 29, 2022, the entire contents of which are incorporated herein by reference.

TECHNICAL FIELD

The present disclosure relates, in general, to sinks, and, more particularly, to dual-sink assemblies for installation in diagonal corner cabinets and associated methods of manufacturing dual-sink assemblies.

BACKGROUND

Sinks may be used in a wide range of residential and commercial settings, including kitchens, bathrooms, and industrial environments, many of which present unique challenges with respect to aesthetic preferences, functional demands, and space limitations. In many cases, it is functionally and aesthetically preferable to install a sink in a corner cabinet. Moreover, it may be desirable to install multiple sinks in the same corner cabinet to increase usable volume available between the sinks for purposes such as dishwashing or to facilitate separate uses of each sink (e.g., dishwashing versus food preparation). However, existing designs for corner sinks offer only limited utility and fail to optimize the use of countertop space surrounding each such corner sink. For the few double sinks designed for installation in corner cabinets, these issues are even more pronounced.

Most commercially-available double sinks designed for installation in corner cabinets are specifically intended for use with 90-degree corner cabinets. A 90-degree corner cabinet provides two working edges that form a 90-degree angle where the working edges meet at a front corner point of the cabinet. In circumstances where a double sink is preferred over a single-bowl sink, 90-degree corner cabinets typically require installation of "butterfly" sinks. Butterfly sinks include two single-bowl sinks, generally oriented at a 90-degree angle with respect to one another, with the two sinks meeting at the closest points of their respective basins so as to accommodate the front corner point of the cabinet in which the sinks are to be installed. Although a butterfly sink allows for the installation of two sinks in a 90-degree corner cabinet, smaller sinks must typically be chosen due to dimensional constraints, while significant countertop space is wasted around a triangular area toward the rear corner of the cabinet farthest from the working edges. Further, the sharp corners of the butterfly sink and the associated 90-degree corner cabinet limit a user's ability to access the respective basins of the two sinks during use except from less ergonomic positions than might be provided for by other sink designs.

A few sink designs are also commercially available for use with diagonal corner cabinets. Unlike the 90-degree corner cabinet, a diagonal corner cabinet offers the user a more ergonomic working edge that is generally aligned at an angle to each of two rear edges meeting at a rear corner point of the cabinet. For example, the two rear edges may be aligned at a 90-degree angle with respect to one another, while the working edge may be aligned at a 45-degree angle with respect to each of the two rear edges. The diagonal corner cabinet provides for alignment of one or more sinks such that the length (left-right dimension) of each sink runs parallel to the working edge of the cabinet and the width (front-back dimension) of each sink runs perpendicular to the working edge of the cabinet. Single-bowl rectangular or "D-shaped" sinks are often installed in diagonal corner cabinets in such a manner. Alternatively, a limited range of double-sink designs may be installed in diagonal corner cabinets, offering varying degrees of utility.

For example, an existing double sink for installation in a diagonal corner cabinet may include two single-bowl sinks arranged side-by-side such that the front- or user-facing walls of their respective basins are aligned and run parallel to the working edge of the diagonal corner cabinet. In such a double-sink arrangement, the respective center points of the two sinks may form an axis that also runs parallel to the working edge of the diagonal corner cabinet. Although side-by-side double-sink designs improve user access to each of the two sinks from the working edge of the diagonal corner cabinet, such designs inherently limit the size of each sink based on the length of the working edge. Moreover, the countertop space behind the double sink is largely wasted or unusable due to inaccessibility.

Another existing option for installing a double sink in a diagonal corner cabinet is to install a one-piece double sink that includes an integral countertop. Such one-piece designs are often similar to the side-by-side double sinks discussed above and present recognizable limitations (e.g., smaller possible sink sizes and wasted countertop space behind or surrounding the double sink). In addition, these one-piece double sinks are typically elevated with respect to the countertops of adjacent cabinets to disguise unsightly and potentially unsanitary seams that would otherwise exist and rarely match the surrounding countertops in material or aesthetics. Further still, one-piece double sinks are often prohibitively expensive to manufacture and far more challenging to install than traditional sinks due to their significant weight and the limited commercial availability of different configurations.

With any of the sink arrangements described herein, material selection for the countertops of the associated cabinets poses yet another design challenge. Popular countertop materials such as marble or granite are brittle and prone to cracking or otherwise breaking if cut too thin or narrow, meaning that sink designs (and particularly those designs including more than one sink) must factor in countertop cutout dimensions, as well, to prevent undue yielding of countertop materials under stress.

These and other challenges and restraints have resulted in a stagnant design environment in which alternative multi-sink designs for installation in corner cabinets are rarely introduced to market. Therefore, it is desirable to provide improved dual-sink assemblies for installation in diagonal corner cabinets and associated methods of manufacturing dual-sink assemblies.

SUMMARY OF THE INVENTION

The present disclosure is directed to dual-sink assemblies for installation in diagonal corner cabinets and associated methods of manufacturing dual-sink assemblies. For example, in accordance with one aspect of the present invention, a dual-sink assembly for installation in a diagonal corner cabinet may include a first sink and a second sink. The first sink may include a first basin and may have a first length, a first width, a first depth, and a first center point located within a first volume defined by the first basin, the first length being greater than the first width. The second sink may include a second basin and may have a second length, a second width, a second depth, and a second center point located within a second volume defined by the second basin, the second length being less than the first length and greater than the second width. The second sink may be attached to the first sink, such as by welding.

The diagonal corner cabinet in which the dual-sink assembly is to be installed may include a countertop. The countertop may include a working edge, a first rear edge oriented at a first angle to the working edge, and a second rear edge oriented at a second angle to the working edge. The second rear edge may intersect the first rear edge at a rear corner point. The dual-sink assembly may be designed for installation in the diagonal corner cabinet such that the first sink is located closer to the working edge than the second sink, the first center point and the second center point being located along a transverse axis extending from the working edge toward the rear corner point. Accordingly, the dual-sink assembly may provide the utility of a first sink and a second sink for use with a diagonal corner cabinet in a manner that optimizes use of space on the countertop and provides additional benefits over existing corner sink designs.

DETAILED DESCRIPTION OF THE INVENTION

Dual-sink assemblies for installation in diagonal corner cabinets and associated methods of manufacture have been developed. A dual-sink assembly may include a first sink and a second sink arranged in a front-back orientation so as to maximize potential sizes of the first sink and the second sink when the dual-sink assembly is installed in a diagonal corner cabinet having given dimensions, thereby minimizing wasted space remaining on a countertop of the diagonal corner cabinet.

The first sink may include a first basin and may have a first length, a first width, a first depth, and a first center point located within a first volume defined by the first basin, the first length being greater than the first width. The second sink may include a second basin and may have a second length, a second width, a second depth, and a second center point located within a second volume defined by the second basin, the second length being less than the first length and greater than the second width. The second sink may be attached to the first sink, such as by welding.

The diagonal corner cabinet in which the dual-sink assembly is to be installed may include a countertop. The countertop may include a working edge, a first rear edge oriented at a first angle to the working edge, and a second rear edge oriented at a second angle to the working edge. The second rear edge may intersect the first rear edge at a rear corner point. The dual-sink assembly may be designed for installation in the diagonal corner cabinet such that the first sink is located closer to the working edge than the second sink, the first center point and the second center point being located along a transverse axis extending from the working edge toward the rear corner point. The sizing and location of the first sink and the second sink with respect to the diagonal corner cabinet may provide for installation of a dual-sink assembly having a greater total usable volume and requiring less wasted countertop space in comparison to existing corner sink designs, double-sink or otherwise.

Figure 1A:
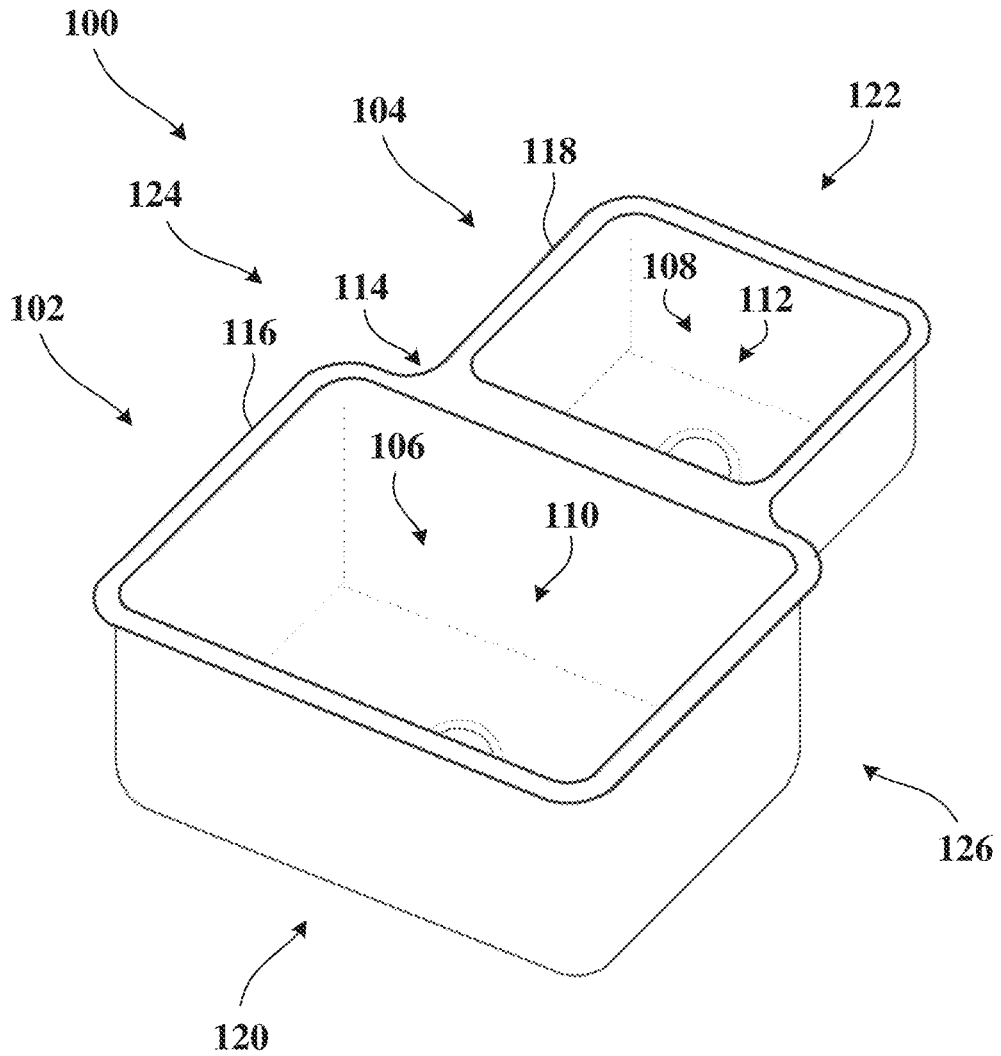
FIGS. 1A-1F are, respectively, a perspective view, a top-down view, a right-side view, a right-side cross-sectional view, a rear view, and a front view of a dual-sink assembly in accordance with aspects of the present invention.

Referring now to FIGS. 1A-1F, and in brief overview, an example dual-sink assembly is illustrated. As shown in FIG. 1A, dual-sink assembly 100 may include sink 102 and sink 104. Sink 102 may include basin 106. Sink 104 may include basin 108. Basin 106 may define volume 110 of sink 102. Basin 108 may define volume 112 of sink 104. Volume 110 may be greater than volume 112 such that a nominal or overall size of sink 102 is greater than that of sink 104.

Sink 102 and sink 104 may each be any type of sink. For example, either of sink 102 or sink 104 may be a rectangular sink, an elliptical or oval-shaped sink, a D-shaped sink, or any other sink. Further, sink 102 and sink 104 may each be formed, constructed, or manufactured from any material, including but not limited to stainless steel, porcelain, enameled cast iron, copper, stone, stone composite, or any other material suitable for use as a sink.

Sink 102 and sink 104 may be off-the-shelf, commercially-available sinks of any size or may be custom-made sinks designed especially for use with any dual-sink assembly described herein. In some embodiments, sink 102 and sink 104 may be attached or connected to one another by welding or any other means of attachment or connection at a suitable location such as location 114 of the present embodiment, thereby forming a single unit. Alternatively, dual-sink assembly 100 may be formed from a single piece of material, which may be accomplished via a molding or pressing process or using any other suitable means of forming a dual-sink assembly from a single piece of material. As will be understood by those having skill in the art, the customizable nature of dual-sink assembly 100 beneficially offers the choice between a cost-effective dual-sink solution that employs standard off-the-shelf sinks in a novel arrangement, a fully custom-formed product for more unique or restrictive applications, and various compromises between the two alternatives.

Dual-sink assembly 100 may be designed for installation in a diagonal corner cabinet using any of various installation techniques. For example, as illustrated by the present embodiment, dual-sink assembly 100 may be a drop-in sink assembly designed to fit into a precut hole (or holes) in a countertop of the diagonal corner cabinet. Sink 102 may be a single bowl drop-in sink, which may include lip 116 surrounding and protruding outward from basin 106. Sink 104 may also be a single bowl drop-in sink, which may include lip 118 surrounding and protruding outward from basin 108. During installation of dual-sink assembly 100 in the diagonal corner cabinet, basin 106 and basin 108 may be set into the precut hole(s) in the countertop, while lip 116 and lip 118 may rest flat atop a work surface of the countertop. Accordingly, lip 116 and lip 118 may be designed to form fluid-tight seals against the work surface of the countertop when dual-sink assembly 100 is installed in the diagonal corner cabinet.

Alternatively, dual-sink assembly 100 may be an undermount sink assembly designed for installation from underneath the countertop of the diagonal corner cabinet in alignment with a precut hole (or holes) or recess (or recesses) in the countertop. Sink 102 may be a single bowl undermount sink, which may include a lip surrounding and protruding outward from basin 106. Sink 104 may also be a single bowl undermount sink, which may include a lip surrounding and protruding outward from basin 108. During installation of dual-sink assembly 100 in the diagonal corner cabinet, basin 106 and basin 108 may be aligned with the precut hole(s) or recess(es) in the countertop, while the respective lips of sink 102 and sink 104 may rest flat against an underside of the countertop. Accordingly, the lips may be designed to form fluid-tight seals against the underside of the countertop when dual-sink assembly 100 is installed in the diagonal corner cabinet. It will further be understood that the respective lips of the single bowl undermount sinks may differ slightly in design from those of lip 116 or lip 118. For example, lip 116 and lip 118 may each have a slight overhanging radius, chamfer, or rim to prevent fluid, dirt, or other undesirable materials from falling through cracks between the countertop and dual-sink assembly 100 and becoming lodged within the diagonal corner cabinet. In contrast, the lips of the single bowl undermount sinks may be designed without any such radii, chamfers, or rims so as to rest flush against the underside of the countertop.

In still other embodiments, dual-sink assembly 100 may be a flush-mount sink assembly integral to a countertop designed for installation atop a diagonal corner cabinet. With such embodiments, dual-sink assembly 100 may be an integral component of a one-piece engineered countertop. As such, the flush-mount sink assembly and integral countertop may be simultaneously installed atop the diagonal corner cabinet.

Dual-sink assembly 100 may be designed such that sink 102 and sink 104 are aligned in a front-back orientation with respect to one another in order to optimize use of the countertop when dual-sink assembly 100 is installed in the diagonal corner cabinet. For orientation purposes, FIG. 1A depicts front 120, rear 122, left side 124, and right side 126 of dual-sink assembly 100. Sink 102 may be located toward front 120 of dual-sink assembly 100, while sink 104 may be located toward rear 122. Left side 124 and right side 126 of dual-sink assembly 100 may substantially mirror one another in design, appearance, and orientation.

Figure 1B:
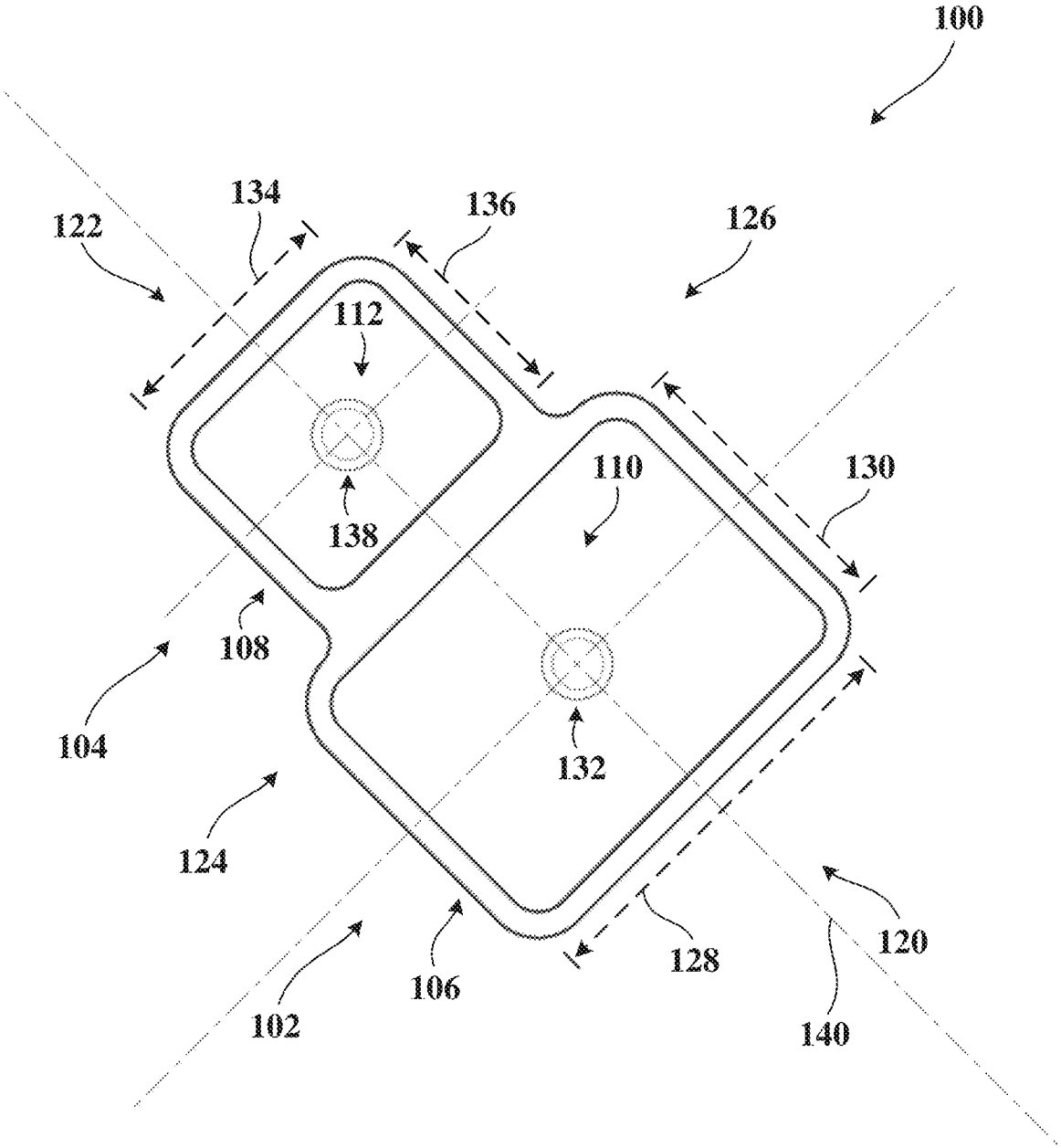

As shown in FIG. 1B, sink 102 may have dimensions including length 128 and width 130 and may further have center point 132 located within volume 110 of basin 106. Sink 104 may have dimensions including length 134 and width 136 and may further have center point 138 located within volume 112 of basin 108. It will be understood by those having skill in the art that length 128 of sink 102 and length 134 of sink 104 are dimensions extending between left side 124 and right side 126 of dual-sink assembly 100, while width 130 of sink 102 and width 136 of sink 104 are dimensions extending between front 120 and rear 122 of dual-sink assembly 100.

The various dimensions and arrangement of sink 102 and sink 104 may be selected to maximize the sizes of the respective sinks that may be installed in a diagonal corner cabinet having a countertop with a given surface area of available work space. For example, length 128 may be greater than width 130 and length 134, while length 134 may be greater than width 136. Dual-sink assembly 100 may further be designed such that axis 140 extends from front 120 to rear 122 of dual-sink assembly 100 through center point 132 of sink 102 and center point 138 of sink 104. In this manner, dual-sink assembly 100 may allow for sink 102 and sink 104 to be greater in size than would otherwise be possible with prior corner double-sink designs installed in the same diagonal corner cabinet. As another design benefit, dual-sink assembly 100 may define a perimeter that minimizes wasted or unused space on the countertop of the diagonal corner cabinet. Further still, the orientation of sink 102 with respect to sink 104 may provide for a user to more easily access sink 104 from a working edge of a countertop than would be possible were width 130 instead greater than length 128. These and other benefits provided by the arrangement of a dual-sink assembly such as dual-sink assembly 100 are further depicted with respect to dual-sink assembly 200 of FIG. 2 (described in further detail below).

Figure 1C:
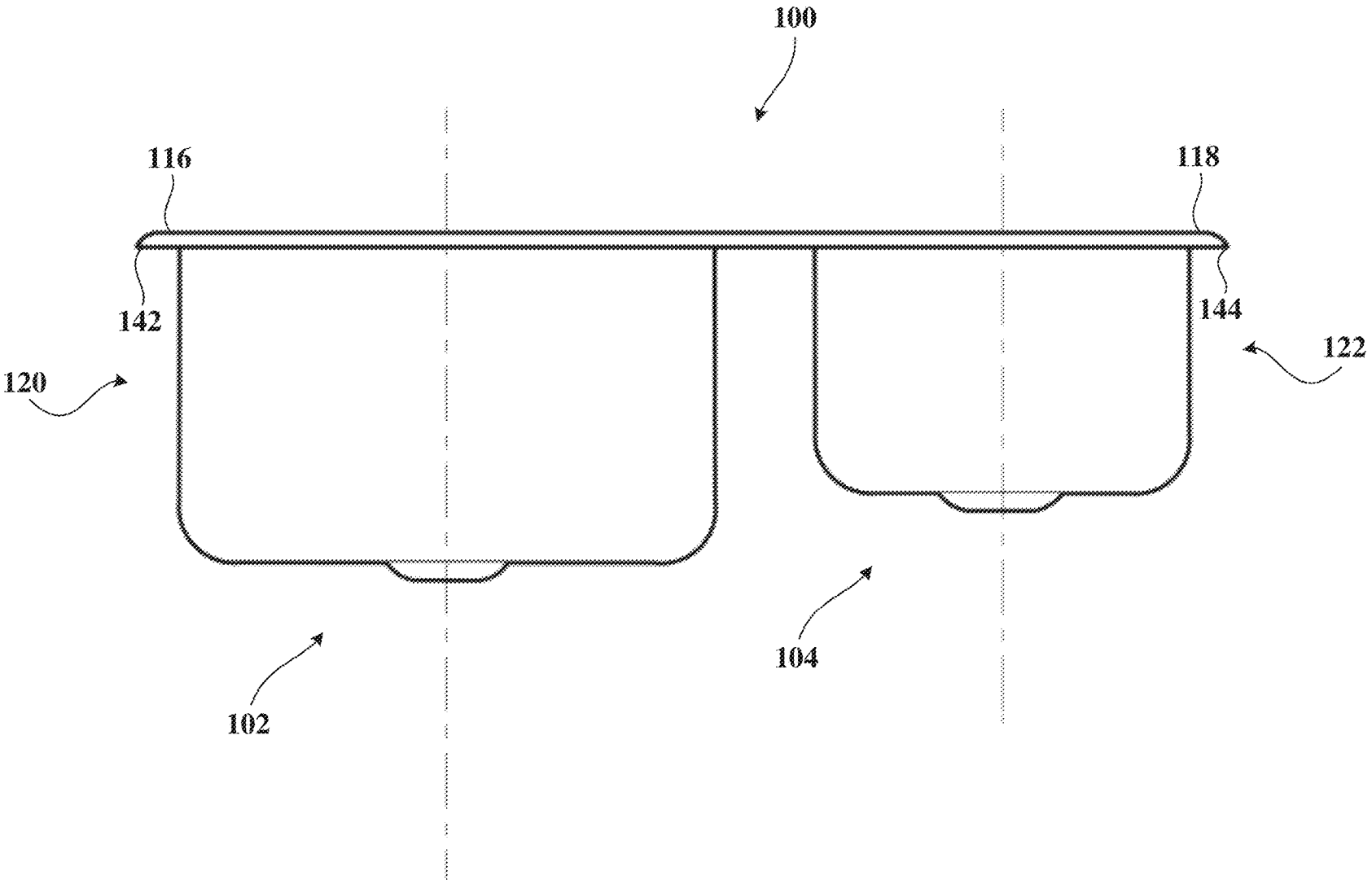

As shown in FIG. 1C (and further described above with respect to FIG. 1A), dual-sink assembly 100 may be a drop-in sink assembly. As such, sink 102 may be a single bowl drop-in sink including lip 116, which may have sealing edge 142, while sink 104 may be a single bowl drop-in sink including lip 118, which may have sealing edge 144. Sealing edge 142 and sealing edge 144 may include slight overhanging radii, chamfers, or rims to form fluid-tight seals with respect to a work surface of a countertop and thereby prevent fluid, dirt, or other undesirable materials from becoming trapped inside the diagonal corner cabinet associated with the countertop. Lip 116 and lip 118 may form a substantially continuous lip defining the perimeter of dual-sink assembly 100 to further improve the sealing characteristics of dual-sink assembly 100 when installed.

Although not depicted in FIG. 1C, dual-sink assembly 100 may, alternatively, be an undermount sink assembly. Further description of such an undermount sink assembly (as well as distinguishing features between the drop-in sink assembly and the undermount sink assembly) are provided above with respect to FIG. 1A.

Figure 1D:
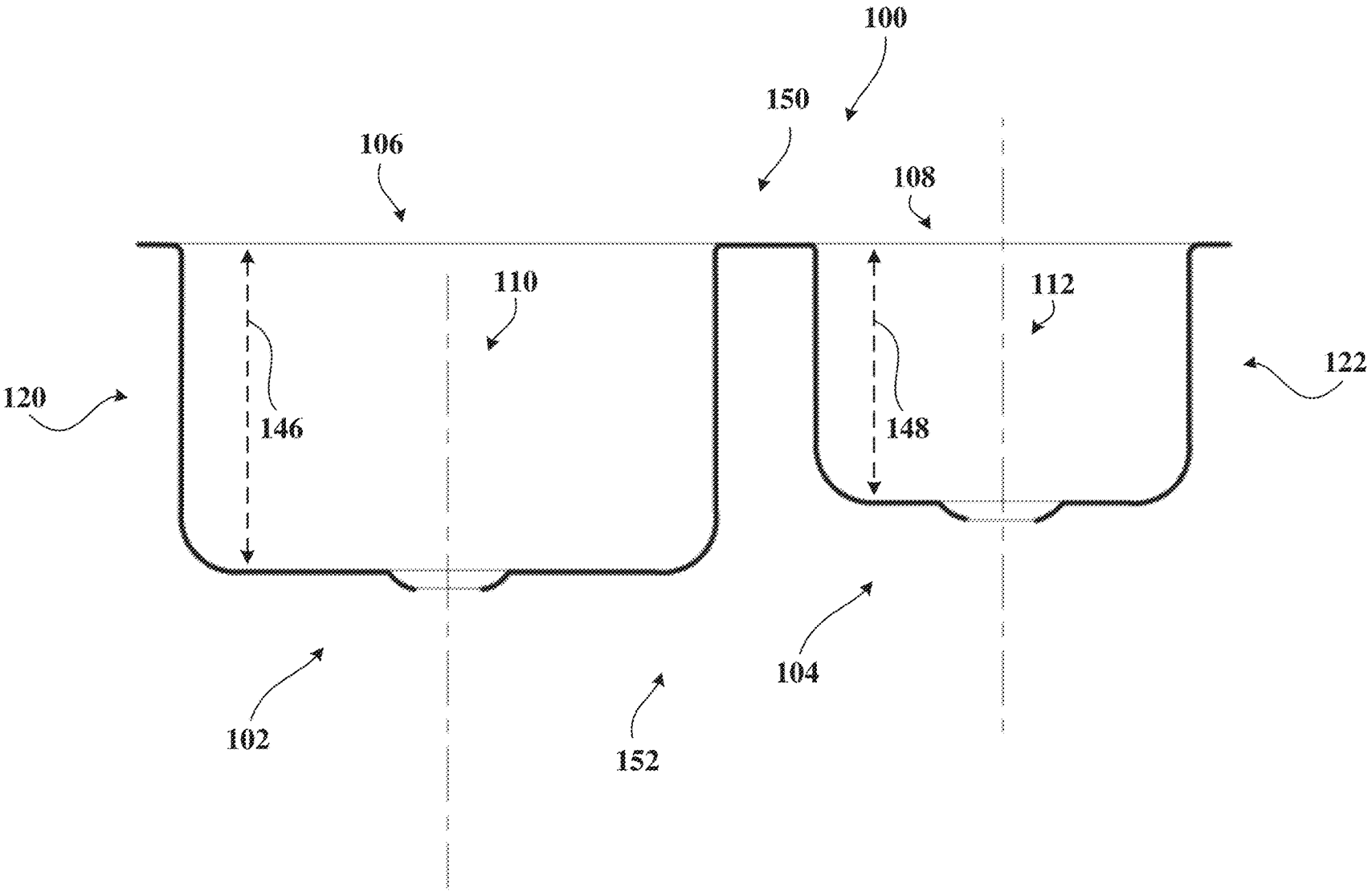
Figure 1E:
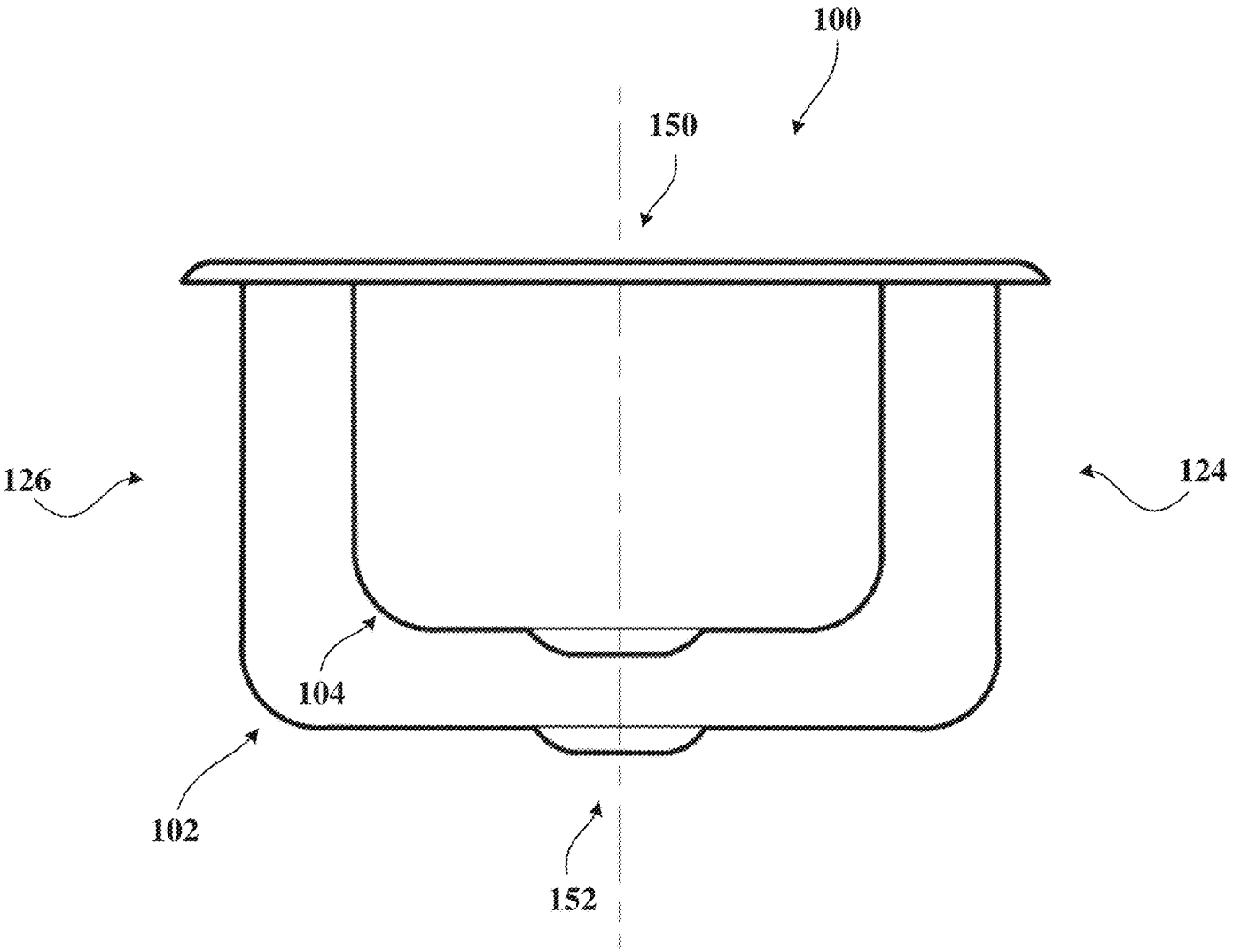
Figure 1F:
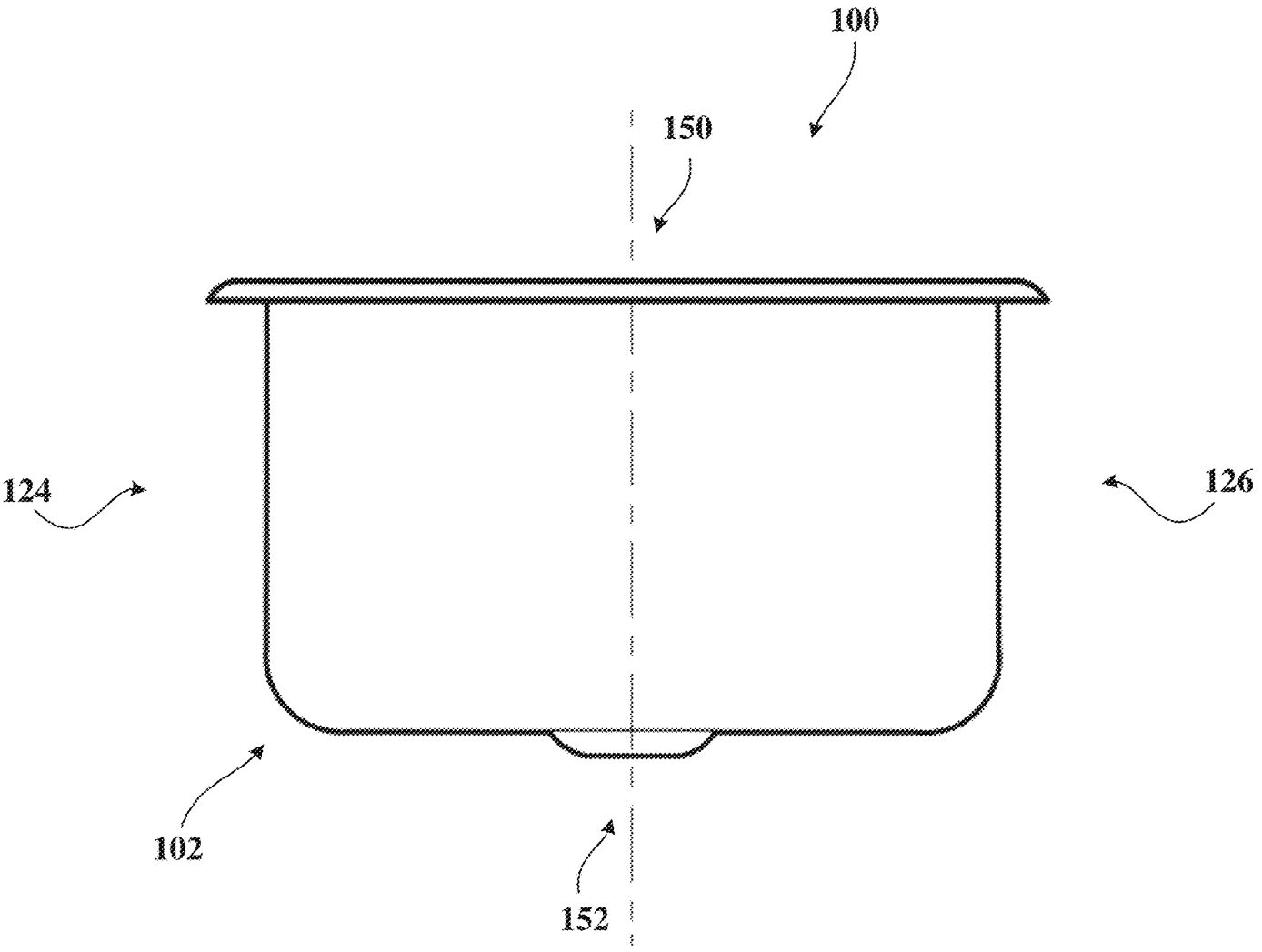

As shown in FIGS. 1D-1F, sink 102 may have depth 146, while sink 104 may have depth 148. Depth 146 and depth 148 may be measured from top 150 toward bottom 152 of dual-sink assembly 100. Depth 146 may be greater than depth 148, which may provide for a greater volume 110 defined by basin 106 as compared to a lesser volume 112 defined by basin 108. This may be desirable when dual-sink assembly 100 is installed in a diagonal corner cabinet, as the sink having the greater volume (i.e., sink 102) may be more readily accessible by a user located closer to front 120 than rear 122 of dual-sink assembly 100 (typically meaning that the user is located adjacent to a working edge of the diagonal corner cabinet).

Nonetheless, sink 102 and sink 104 may be selected such that each of depth 146 and depth 148 extends a sufficient depth from top 150 of dual-sink assembly 100 to facilitate desirable use of both sink 102 and sink 104. For example, depth 148 may be at least a minimum depth to accommodate one or more dishware or food items in basin 108 below a spout of a faucet installed on the countertop of the diagonal corner cabinet in which dual-sink assembly 100 may also be installed. Accordingly, depth 146 may provide at least the same degree of accommodation for dishware or food items in basin 106 below the same spout of the faucet installed on the countertop.

Figure 2:
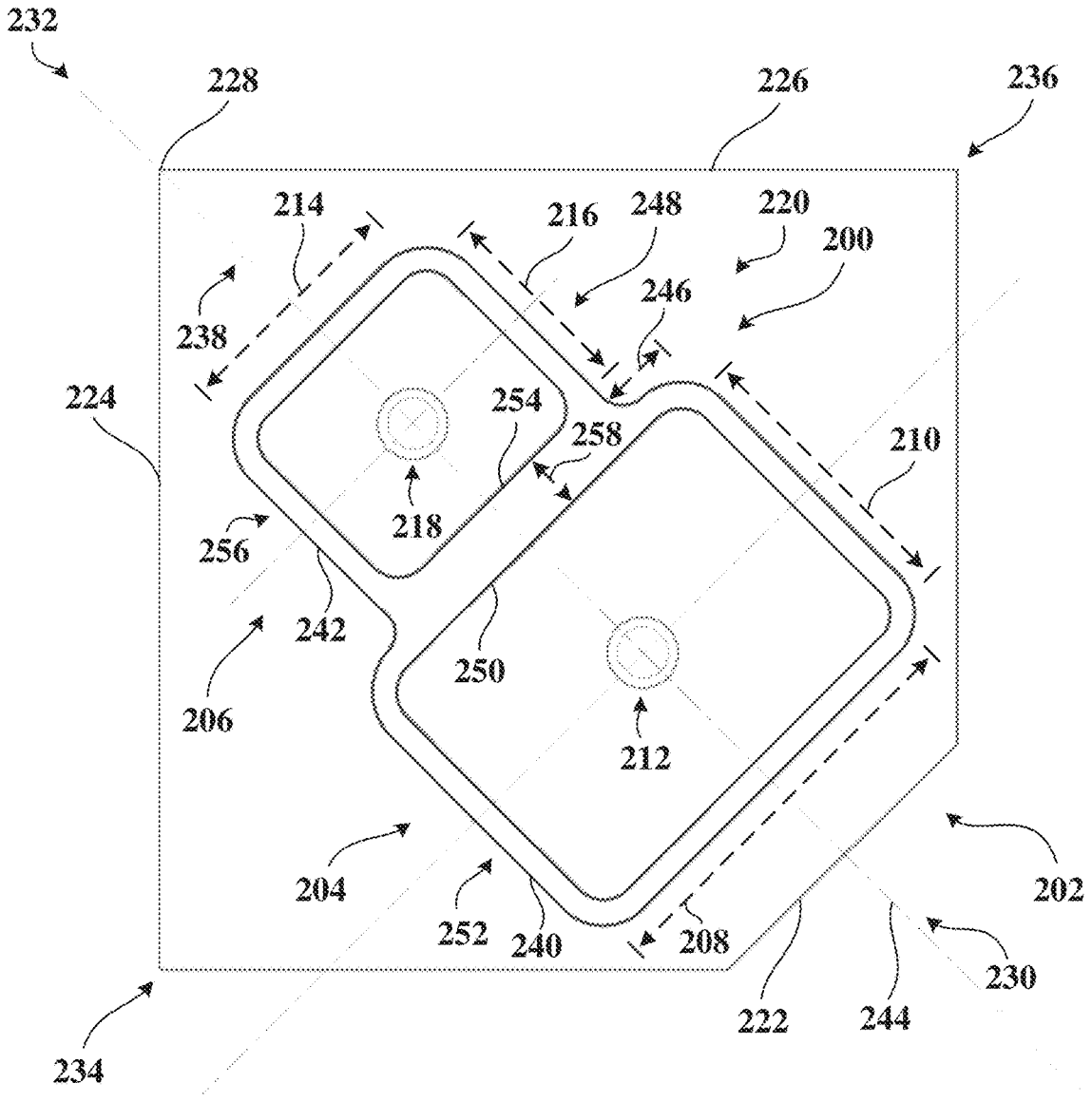
FIG. 2 is a top-down view of a dual-sink assembly installed in a diagonal corner cabinet in accordance with aspects of the present invention.

Referring now to FIG. 2, and in brief overview, a dual-sink assembly may be installed in a diagonal corner cabinet. As shown in FIG. 2, dual-sink assembly 200 may be installed in diagonal corner cabinet 202. It will be understood that dual-sink assembly 200 may be the same as or similar to dual-sink assembly 100 of FIGS. 1A-1F or may be any other dual-sink assembly in accordance with the principles of the present disclosure. Similarly, the various components and dimensions of dual-sink assembly 200 may be the same as or similar to components and dimensions described with respect to dual-sink assembly 100 of FIGS. 1A-1F or may be any other components and dimensions. For example, sink 204 and sink 206 of dual-sink assembly 200 may be the same as or similar to, respectively, sink 102 and sink 104 of dual-sink assembly 100 of FIGS. 1A-1F or may be any other type(s) of sink. Accordingly, length 208, width 210, and center point 212 of sink 204 may or may not correspond to length 128, width 130, and center point 132 of sink 102, while length 214, width 216, and center point 218 of sink 206 may or may not correspond to length 134, width 136, and center point 138 of sink 104. Further still, diagonal corner cabinet 202 may be the same as or similar to any diagonal corner cabinet described throughout the present disclosure or may be a different diagonal corner cabinet in which dual-sink assembly 200 may be installed.

Diagonal corner cabinet 202 may include countertop 220. Countertop 220 may include working edge 222, rear edge 224, and rear edge 226. Rear edge 224 and rear edge 226 may each be oriented at an angle with respect to working edge 222 and further with respect to one another. As such, rear edge 224 and rear edge 226 may intersect at rear corner point 228 of diagonal corner cabinet 202. Working edge 222 may be located toward front 230 of diagonal corner cabinet 202 and may be preferably accessible by a user in a location where diagonal corner cabinet 202 is installed or otherwise situated. Rear corner point 228 may be located toward rear 232 of diagonal corner cabinet 202 such that diagonal corner cabinet 202 may be installed with rear edge 224 and rear edge 226 abutting adjacent corner walls of the location selected for installation.

Diagonal corner cabinet 202 may be any commercially-available or custom-made diagonal corner cabinet. For instance, diagonal corner cabinet 202 may be nominally referred to as a 36-inch diagonal corner cabinet, meaning that rear edge 224 and rear edge 226 may each measure 36 inches in length, may be oriented at a 90-degree angle with respect to one another, and may each be oriented at a 45-degree angle with respect to working edge 222. As another example, diagonal corner cabinet 202 may be a 42-inch diagonal corner cabinet with rear edge 224 and rear edge 226 each measuring 42 inches in length and being oriented at similar angles with respect to one another and to working edge 222 as would be the case with a 36-inch diagonal corner cabinet.

Dual-sink assembly 200 may be designed for installation in diagonal corner cabinet 202 such that sink 204 is located closer to working edge 222 than sink 206. Accordingly, sink 206 may be located closer to rear corner point 228 than sink 204. Put another way, sink 204 may be located closer to front 230 than sink 206, while sink 206 may be located closer to rear 232 than sink 204. As such, dual-sink assembly 200 may be referred to as a "front-back" sink design.

Sink 204 and sink 206 may be oriented with respect to one another in an arrangement that maximizes utilization of countertop 220 when dual-sink assembly 200 is installed in diagonal corner cabinet 202. For example, center point 212 of sink 204 and center point 218 of sink 206 may be located along transverse axis 244 extending from working edge 222 toward rear corner point 228. Moreover, sink 204 and sink 206 may be positioned such that length 208 and length 214 both run parallel to working edge 222 between left corner 234 and right corner 236 of diagonal corner cabinet 202. Further still, length 208 may be greater than width 210 and length 214, while length 214 may be greater than width 216. Arranging dual-sink assembly 200 in this manner may maximize the available surface area collectively provided for use by sink 204 and sink 206, while simultaneously minimizing wasted or difficult-to-access surface area on countertop 220 that is not occupied by sink 204 or sink 206 (particularly toward rear 232 of diagonal corner cabinet 202 in area 238 of countertop 220). As another benefit of this arrangement, a user of dual-sink assembly 200 may have improved access to sink 204 and sink 206 due to the greater relative lengths of length 208 and length 214 reachable from working edge 222 (as opposed to an alternative arrangement in which, for instance, length 208 and length 214 were equal to one another but less than width 210 and/or width 216, which would diminish ease of access to at least sink 206).

Regardless of the nominal size of diagonal corner cabinet 202, dual-sink assembly 200 may preferably allow for sink 204 and sink 206 to be of larger sizes than would be possible with most prior double-sink designs. For example, the majority of existing double sinks are aligned left-to-right (i.e., along their shared x-axis, as viewed from the front of the double sink), which precludes the maximum length of each sink from being greater than at least length 208 of sink 204 when installed in the same diagonal corner cabinet 202. As such, dual-sink assembly 200 offers the ability to install two sinks (i.e., sink 204 and sink 206) in diagonal corner cabinet 202 that collectively provide more usable surface area than any existing double sinks able to be installed in diagonal corner cabinet 202. The existing left-to-right double-sink arrangements also leave a great deal of wasted surface area behind the double sink, another detriment that is avoided with the design of dual-sink assembly 200.

With further respect to the beneficial arrangement of dual-sink assembly 200, sink 204 and sink 206 may be arranged in a manner that accommodates one or more fixtures (plumbing-related or otherwise) in locations on countertop 220 that would be rendered inaccessible to such fixtures by many prior double-sink designs (particularly one-piece double sinks with integral countertops). For example, lip 240 of sink 204 may be offset from lip 242 of sink 206, relative to transverse axis 244, by length 246. Accordingly, length 246 and width 216 may define offset area 248 on countertop 220. When dual-sink assembly 200 is installed in diagonal corner cabinet 202, a fixture (not shown) may be installed on countertop 220 such that at least a portion of the fixture is accommodated within offset area 248. The fixture may be, for example, a faucet, a soap dispenser, or any other fixture generally associated with a sink assembly. It will further be understood that offset area 248 may be located, as preferred, on either side of sink 206.

Dual-sink assembly 200 may be designed for installation in diagonal corner cabinet 202 using various techniques. For example, dual-sink assembly 200 may be a drop-in sink assembly, an undermount sink assembly, or a flush-mount sink assembly. Where dual-sink assembly 200 is a drop-in sink assembly (as depicted in FIG. 2), sink 204 and sink 206 may both be single bowl drop-in sinks, possibly welded or otherwise fixed to one another, with lip 240 and lip 242 being designed to form fluid-tight seals against a work surface of countertop 220 when dual-sink assembly 200 is installed in diagonal corner cabinet 202. Alternatively, where dual-sink assembly 200 is an undermount sink assembly, sink 204 and sink 206 may both be single bowl undermount sinks, possibly welded or otherwise fixed to one another, with lip 240 and lip 242 being designed to form fluid-tight seals against an underside of countertop 220 when dual-sink assembly 200 is installed in diagonal corner cabinet 202. As still another alternative, where dual-sink assembly 200 is a flush-mount sink assembly, sink 204 and sink 206 may be surrounded by an integral countertop (not shown) for installation atop diagonal corner cabinet 202, with dual-sink assembly 200 being collectively formed from a single piece of engineered material for a streamlined appearance.

Material selection for the various components of dual-sink assembly 200 and diagonal corner cabinet 202 may depend on a variety of aesthetic, functional, and economic considerations. For example, sink 204 and sink 206 may be formed from a range of materials, including but not limited to stainless steel, aluminum, enameled cast iron, copper, granite, marble, or other natural stone, quartz, fireclay, porcelain, ceramic, acrylic, or composite material. Countertop 220 may also be composed of any number of materials, including but not limited to wood, laminate, marble, granite, or other natural stone, and quartz or other engineered stone. It will be understood that certain materials may be selected due to their preferable appearance and/or cost, which may be balanced against functional requirements (e.g., yield strength, cleaning requirements, and/or longevity) for a particular type of installation.

For example, due to varying material characteristics, it may be preferable from a functional standpoint to use a drop-in sink assembly when countertop 220 is composed of wood or laminate material, whereas it may be preferable to use an undermount sink assembly when countertop 220 is composed of granite, marble, or other natural stone. Flush-mount sink assemblies with integral countertops may typically be composed of engineered stone such as quartz, which may allow formation of single-piece sink assemblies from the same material.

The material used to form sink 204 may be the same as or different from that used to form sink 206, depending on variables such as commercial availability of various sink designs in certain materials or preferred means of attachment between sink 204 and sink 206. For example, sink 204 and sink 206 may only be welded together if certain weld-compatible materials are used for each of the two sinks (e.g., stainless steel welded to stainless steel), as will be understood by those having skill in the art. Countertop 220 may be formed from the same material as sink 204 and/or sink 206 or may be formed from a different material entirely. For example, sink 204 and sink 206 may be formed from a different material than that of countertop 220 where dual-sink assembly 200 is a drop-in sink assembly or an undermount sink assembly, whereas sink 204, sink 206, and countertop 220 may be formed from a single continuous piece of the same material where dual-sink assembly 200 is a flush-mount sink assembly.

Because of the many combinations of materials that may be used between dual-sink assembly 200 and diagonal corner cabinet 202, preventing damage to countertop 220 while still ensuring optimal use of available work space requires careful arrangement of sink 204 and sink 206 with respect to each other as well as countertop 220. For one, if sink 204 and sink 206 are spaced too far apart from one another, they may not fit within the available surface area of countertop 220 or may leave undesirable gaps that prove difficult to access for cleaning or simply amount to wasted space. If sink 204 and sink 206 are arranged too closely to one another, however, the material of countertop 220 may need to be cut so narrowly or thinly that only a weak dividing portion of material remains between the cutout intended for sink 204 and the cutout intended for sink 206. This may be a particularly critical issue with undermount sink assemblies or other sink assemblies where countertop 220 is composed of granite, marble, or another brittle material.

To address this issue, dual-sink assembly 200 may be arranged such that wall 250 of basin 252 of sink 204 may be offset from wall 254 of basin 256 of sink 206 along transverse axis 244 by width 258. Width 258 may be selected based on a number of variables. For example, width 258 may be selected to optimize use of available space within a perimeter defined by countertop 220 (e.g., maximizing overall surface area occupied by sink 204 and sink 206) while protecting the material of countertop 220 from being damaged due to stress or wear.

Specifically, width 258 may be selected to ensure that the narrowest or thinnest portion of countertop 220 (i.e., the portion having width 258) may support the weight of dual-sink assembly 200 (such as with a drop-in sink assembly, where dual-sink assembly 200 may rest atop countertop 220) and/or have sufficient durability to tolerate wear during use (such as with an undermount sink assembly, where dual-sink assembly 200 may rest beneath countertop 220, leaving the narrowest or thinnest portion of countertop 220 exposed to the user). Width 258 may be any width that accomplishes these and other functional or aesthetic goals. For example, width 258 may measure 3 inches, 2.5-3.5 inches, 2-4 inches, 1-5 inches, or any other width that optimizes use of available space while protecting the material of countertop 220 from stress- or wear-related damage. Width 258 may be based, in part, on one or more characteristics (e.g., yield strength, ductility, and/or toughness) of the material from which countertop 220 is formed. In this manner, dual-sink assembly 200 may be further customized to suit installation in diagonal corner cabinet 202.

In view of the extensive opportunities for functional and aesthetic customization provided by the design of dual-sink assembly 200, it will be understood that dual-sink assembly 200 may be installed in any setting requiring one or more sinks. For example, dual-sink assembly 200 may be installed in a kitchen, bathroom, restaurant, bar, workshop, or any other residential or commercial setting.

Figure 3:
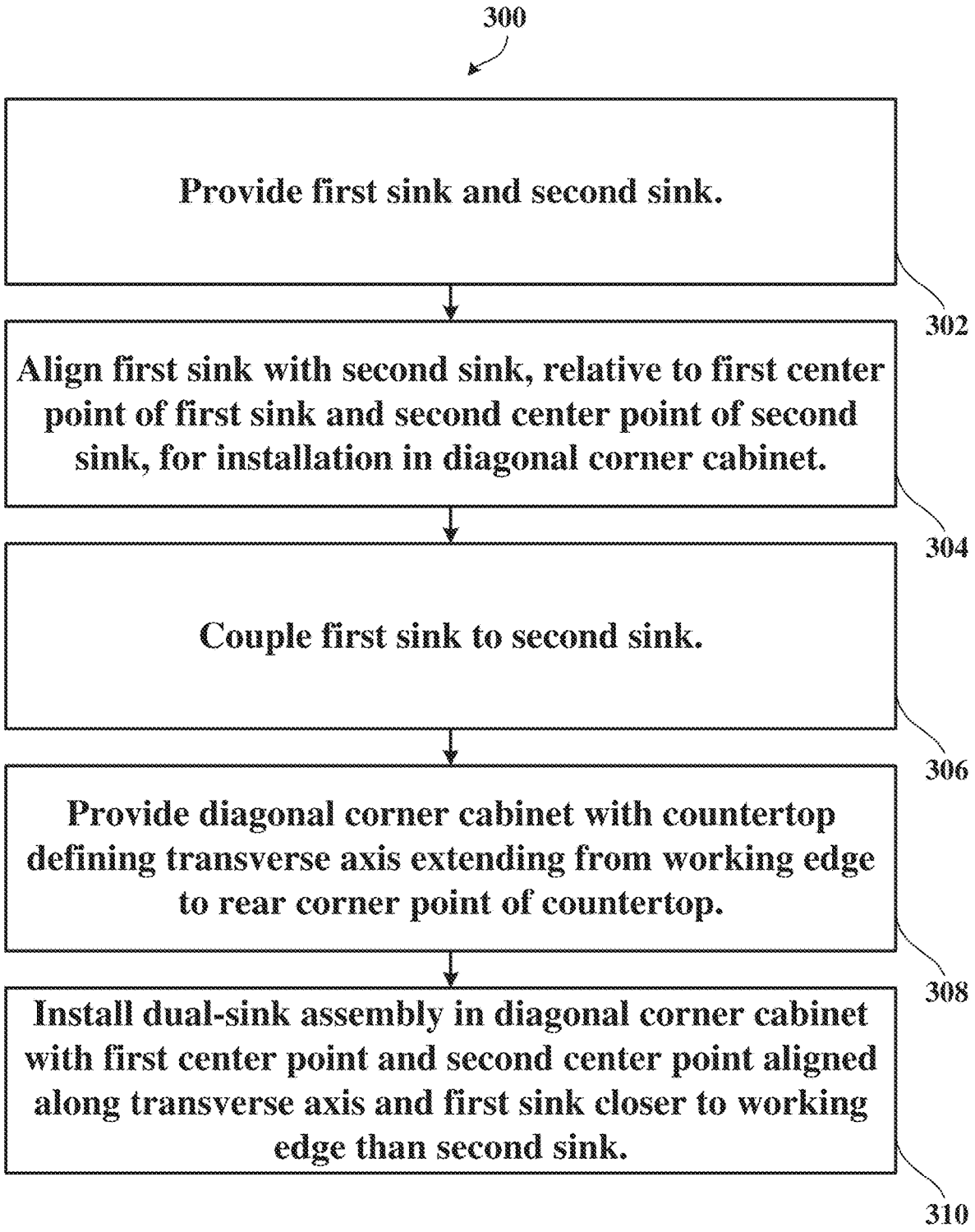
FIG. 3 is a flowchart illustrating example steps for manufacturing a dual-sink assembly and installing the dual-sink assembly in a diagonal corner cabinet in accordance with principles of the present invention.

Referring now to FIG. 3, and in brief overview, process 300 illustrates example steps for manufacturing a dual-sink assembly and/or installing the dual-sink assembly in a diagonal corner cabinet in accordance with the principles of the present invention. It will be understood that the dual-sink assembly described in relation to FIG. 3 may be the same as or similar to any of the dual-sink assemblies described herein (e.g., dual-sink assembly 100 of FIGS. 1A-1F and/or dual-sink assembly 200 of FIG. 2) or may be any other dual-sink assembly. Similarly, any of the components or dimensions of the dual-sink assembly described in relation to FIG. 3 may be the same as or similar to any components or dimensions of the dual-sink assemblies described herein or may be any other such components or dimensions. For example, the sinks described with respect to FIG. 3 may be the same as or similar to sink 102 and sink 104 of FIGS. 1A-1F and/or sink 204 and sink 206 of FIG. 2 or may be any other type(s) of sink. Accordingly, the dimensions and arrangement of the sinks described with respect to FIG. 3 may be the same as or similar to those dimensions and arrangements described with respect to sink 102 and sink 104 of FIGS. 1A-1F and/or sink 204 and sink 206 of FIG. 2 or may be any other such dimensions and arrangements. Moreover, the diagonal corner cabinet described with respect to FIG. 3 may be the same as or similar to any other diagonal corner cabinet described herein (e.g., the diagonal corner cabinet described with respect to FIGS. 1A-1F and/or diagonal corner cabinet 202 of FIG. 2) or may be any other diagonal corner cabinet in which a dual-sink assembly may be installed. It will further be understood that any of the steps described below are merely illustrative, may be optional, and may be completed in any order, depending on the particular embodiment or application of the present invention.

As shown in FIG. 3, at step 302, a first sink and a second sink may be provided. The first sink may include a first basin and may have dimensions including a first length, a first width, and a first depth. The first length may be greater than the first width. The first sink may have a first center point, which may be located within a first volume defined by the first basin. The second sink may include a second basin and may have dimensions including a second length, a second width, and a second depth. The second length may be less than the first length and/or greater than the second width. The second sink may have a second center point, which may be located within a second volume defined by the second basin.

The first depth may be greater than the second depth. As further described with respect to FIG. 2, the second depth may be at least a minimum depth to accommodate one or more dishware or food items in the second basin below a spout of a faucet installed on a countertop of the diagonal corner cabinet in which the dual-sink assembly may also be installed. Accordingly, the first depth may provide at least the same degree of accommodation for dishware or food items in the first basin below the same spout of the faucet installed on the countertop.

As previously noted, the various lengths described herein may generally be measured from left to right, widths may be measured from front to back, and depths may be measured from top to bottom as viewed by a user with the dual-sink assembly installed in the diagonal corner cabinet, in accordance with industry standards. The dimensions of the first sink and the second sink may be selected to provide for optimal arrangement of the first sink and the second sink with respect to a given diagonal corner cabinet in which the dual-sink assembly is to be installed. For example, the respective lengths, widths, and depths of the diagonal corner cabinets may be selected based on the largest-sized sinks that may be accommodated within the perimeter of a countertop of the given diagonal corner cabinet while still allowing preferable access by a user after installation or may be selected to achieve various other functional, aesthetic, and/or economic goals.

As further described with respect to the sinks of FIGS. 1A-1F and FIG. 2, the first sink and the second sink may each be formed, constructed, or manufactured from any material, including but not limited to stainless steel, porcelain, enameled cast iron, copper, stone, stone composite, or any other material suitable for use as a sink. The first sink and the second sink may be composed of the same or different materials from one another. Further, the first sink and the second sink may be off-the-shelf, commercially available sinks of any size or may be custom-made sinks designed especially for use with a dual-sink assembly.

At step 304, the first sink may be aligned with the second sink in a preferable orientation for installation in a diagonal corner cabinet. For example, the first center point of the first sink and the second center point of the second sink may be aligned along an axis such that the first sink may be located in front of the second sink with respect to a user when the dual-sink assembly is installed in the diagonal corner cabinet. Aligned as such, the first length of the first sink may run parallel to the second length of the second sink.

In order to optimize use of available space and prevent damage to the countertop when the dual-sink assembly is installed in the diagonal corner cabinet, the first sink and the second sink may be aligned such that a first wall of the first basin is located an offset width from a second wall of the second basin along the axis associated with the first center point and the second center point. The offset width between the first wall and the second wall may measure, for example, 3 inches, 2.5-3.5 inches, 2-4 inches, 1-5 inches, or any other width that optimizes use of available space while protecting the material of the countertop from stress- or wear-related damage. The offset width may be based, in part, on one or more characteristics (e.g., yield strength, ductility, and/or toughness) of the material from which the countertop is formed. In this manner, the dual-sink assembly may be further customized to suit installation in the diagonal corner cabinet. Additional considerations and benefits of aligning the first sink and the second sink with any such offset width are described in further detail with respect to FIG. 2.

The first sink and the second sink may be further aligned such that a first lip surrounding the first basin of the first sink is located an offset length from a second lip surrounding the second basin of the second sink, relative to the axis associated with the first center point and the second center point. As such, the dual-sink assembly may accommodate at least a portion of a fixture such as a faucet or a soap dispenser for installation on the countertop of the diagonal corner cabinet within an area defined, for instance, by the offset length and the second width.

At step 306, the first sink may be coupled to the second sink. For example, the first sink may be attached, connected, or otherwise fixed to the second sink by welding, molding, or any other process by which the first sink and the second sink may form a single unit. The single unit formed by coupling the first sink to the second sink may form, in whole or in part, the dual-sink assembly.

At step 308, a diagonal corner cabinet may be provided. The diagonal corner cabinet may include a countertop. The countertop may include a working edge, a first rear edge, and second rear edge. The first rear edge and the second rear edge may each be oriented at an angle with respect to the working edge and further with respect to one another. As such, the first rear edge and the second rear edge may intersect at a rear corner point of the diagonal corner cabinet. The working edge may be located toward the front of the diagonal corner cabinet (as viewed by a user) and may be preferably accessible by the user in a location where the diagonal corner cabinet is installed or otherwise situated. The rear corner point may be located toward the rear of the diagonal corner cabinet (as viewed by the user) such that the diagonal corner cabinet may be installed with the first rear edge and the second rear edge abutting adjacent corner walls of the location selected for installation.

The diagonal corner cabinet may be any commercially-available or custom-made diagonal corner cabinet described herein or otherwise envisioned by the present disclosure. Similarly, various dimensions of the diagonal corner cabinet (including but not limited to dimensions of the working edge, the first rear edge, and/or the second rear edge) may be any such dimensions provided for or otherwise envisioned by the present disclosure.

The dimensions of the diagonal corner cabinet may define a transverse axis extending from the working edge toward the rear corner point. As further explained below with respect to step 310, this transverse axis may correspond to and/or align with the axis that is associated with the first center point of the first sink and the second center point of the second sink. Accordingly, the dual-sink assembly may be optimally designed or selected for installation in the diagonal corner cabinet.

The countertop of the diagonal corner cabinet may be composed of any number of materials, including but not limited to wood, laminate, marble, granite, or other natural stone, and quartz or other engineered stone. The material from which the countertop is composed may be the same material as any material from which the first sink and/or the second sink are formed, constructed, or manufactured or may be a different material. As further described throughout the present disclosure, certain materials may be selected due to their preferable appearance and/or cost, which may be weighed against functional requirements (e.g., yield strength, cleaning requirements, and/or longevity) for particular installation scenarios (e.g., drop-in sink installations, undermount sink installations, or flush-mount sink installations).

At step 310, the dual-sink assembly may be installed in the diagonal corner cabinet. For purposes of installation, the first center point of the first sink and the second center point of the second sink may be aligned along the transverse axis defined by the diagonal corner cabinet such that the first sink is located closer to the working edge of the diagonal corner cabinet than the second sink. The descriptions accompanying FIGS. 1A-1F and FIG. 2 explain numerous benefits associated with aligning a dual-sink assembly with a diagonal corner cabinet in such a manner. For the sake of brevity, these beneficial features will not be reproduced here. It will, however, be understood that installing the dual-sink assembly in the diagonal corner cabinet with the alignment described herein may optimize use of available space for a given diagonal corner cabinet in a manner not considered by prior corner sink arrangements (double-sink or otherwise).

As further described with respect to FIGS. 1A-1F and FIG. 2, any of various installation techniques may be used to install the dual-sink assembly in the diagonal corner cabinet, while the dual-sink assembly may be designed to accommodate a particular installation technique. It will be understood that the dual-sink assembly may be installed in the diagonal corner cabinet using any number of attachment techniques. For example, the dual-sink assembly may be attached to the diagonal corner cabinet by any combination of fasteners, glues, adhesives, sealants, or other means suitable for attaching a sink assembly to a cabinet (on a countertop or otherwise). It will further be understood that any particular installation technique may be selected due to various functional, aesthetic, and/or economic considerations associated with a particular installation scenario, as further described throughout the present disclosure.

For example, the dual-sink assembly may be a drop-in sink assembly. In this case, the first sink may be a first single-bowl drop-in sink that includes the first lip surrounding the first basin, while the second sink may be a second single-bowl drop-in sink that includes the second lip surrounding the second basin. The first lip and the second lip may be designed to form fluid-tight seals against a work surface of the countertop when the dual-sink assembly is installed in the diagonal corner cabinet.

Alternatively, the dual-sink assembly may be an undermount sink assembly. In this case, the first sink may be a first single-bowl undermount sink that includes the first lip surrounding the first basin, while the second sink may be a second single-bowl undermount sink that includes the second lip surrounding the second basin. The first lip and the second lip may be designed to form fluid-tight seals against an underside of the countertop when the dual-sink assembly is installed in the diagonal corner cabinet.

As yet another alternative, the dual-sink assembly may be a flush-mount sink assembly integral to a countertop designed for installation atop the diagonal corner cabinet. In this case, the dual-sink assembly may be an integral component of a one-piece engineered countertop. As such, the flush-mount sink assembly and integral countertop may be simultaneously installed atop the diagonal corner cabinet.

Although specific embodiments of the present disclosure have been described herein, one of ordinary skill in the art will recognize that numerous other modifications and alternative embodiments are within the scope of the disclosure. For example, any functionality described with respect to a particular device or component may be performed by any other device or component. Further, while various illustrative implementations have been described in accordance with embodiments of the disclosure, one of ordinary skill in the art will appreciate that numerous other modifications to the illustrative implementations described herein are also within the scope of the disclosure.

Certain aspects of the disclosure are described above with reference to block and/or flow diagrams of systems, methods, and apparatuses according to example embodiments. It will be understood that one or more blocks of any block and/or flow diagram, and combination(s) of blocks in the block and/or flow diagrams, respectively, may not necessarily need to be performed in the order presented or may not necessarily need to be performed at all, according to some embodiments. Further, additional components and/or operations beyond those depicted in blocks of any block and/or flow diagram may be present in certain embodiments.

Although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among other language, "can," "could," "might," or "may," unless specifically stated otherwise, or otherwise understood within the context as used, is generally intended to convey that certain embodiments could include, while other embodiments do not include, certain features, elements, and/or steps. Thus, such conditional language is not generally intended to imply that features, elements, and/or steps are in any way required for one or more embodiments or that one or more embodiments necessarily require deciding whether these features, elements, and/or steps are included or are to be performed in any particular embodiment.

What is claimed is:

1. A dual-sink assembly for installation in a diagonal corner cabinet, the dual-sink assembly comprising:

a first single-bowl sink comprising a first basin, the first sink having a first length, a first width, a first depth, and a first center point disposed within a first volume defined by the first basin, the first length being greater than the first width; and a second single-bowl sink coupled to the first sink by welding, the second sink comprising a second basin and having a second length, a second width, a second depth, and a second center point disposed within a second volume defined by the second basin, the second length being less than the first length and greater than the second width, wherein the diagonal corner cabinet comprises a countertop, the countertop comprising:

a working edge;

a first rear edge, disposed at a first angle to the working edge; and a second rear edge, disposed at a second angle to the working edge, intersecting the first rear edge at a rear corner point, and wherein the dual-sink assembly is configured to be installed in the diagonal corner cabinet such that the first sink is located closer to the working edge than the second sink, the first center point and the second center point being disposed along a transverse axis extending from the working edge toward the rear corner point, the second sink being disposed between the first sink and the rear corner point such that the second length accommodates a convergence of the first rear edge and the second rear edge toward the rear corner point, and wherein a first lip of the first sink is disposed an offset length from a second lip of the second sink, relative to the transverse axis, to accommodate at least a portion of a faucet or a soap dispenser for installation on the countertop within an area defined by the offset length and the second width.

2. The dual-sink assembly of claim 1, wherein the first sink is formed from a first material, the second sink is formed from a second material that is the same as or different from the first material, and the countertop is formed from a third material that is different from the first material and the second material.

3. The dual-sink assembly of claim 1, wherein a first wall of the first basin is disposed an offset width, along the transverse axis, from a second wall of the second basin.

4. The dual-sink assembly of claim 3, wherein the offset width is between 2 and 4 inches.

5. The dual-sink assembly of claim 3, wherein the offset width is based on a yield strength of a material from which the countertop is formed.

6. The dual-sink assembly of claim 1, wherein the first depth is greater than the second depth.

7. The dual-sink assembly of claim 1, wherein the dual-sink assembly is a drop-in sink assembly, the first sink is a first single bowl drop-in sink comprising a first lip surrounding the first basin, and the second sink is a second single bowl drop-in sink comprising a second lip surrounding the second basin, and wherein the first lip and the second lip are configured to form fluid-tight seals against a work surface of the countertop when the dual-sink assembly is installed in the diagonal corner cabinet.

8. The dual-sink assembly of claim 1, wherein the dual-sink assembly is an undermount sink assembly, the first sink is a first single bowl undermount sink comprising a first lip surrounding the first basin, and the second sink is a second single bowl undermount sink comprising a second lip surrounding the second basin, and wherein the first lip and the second lip are configured to form fluid-tight seals against an underside of the countertop when the dual-sink assembly is installed in the diagonal corner cabinet.

9. A method of manufacturing a dual-sink assembly for installation in a diagonal corner cabinet, the method comprising:

providing a first single-bowl sink comprising a first basin, the first sink having a first length, a first width, a first depth, and a first center point disposed within a first volume defined by the first basin, the first length being greater than the first width;

providing a second single-bowl sink comprising a second basin, the second sink having a second length, a second width, a second depth, and a second center point disposed within a second volume defined by the second basin, the second length being less than the first length and greater than the second width;

aligning the first sink with the second sink such that the first center point and the second center point are disposable along an axis defined by the diagonal corner cabinet during installation of the dual-sink assembly in the diagonal corner cabinet, wherein the diagonal corner cabinet comprises a countertop, the countertop comprising:

a working edge;

a first rear edge, disposed at a first angle to the working edge; and a second rear edge, disposed at a second angle to the working edge, intersecting the first rear edge at a rear corner point, wherein the axis is a transverse axis extending from the working edge toward the rear corner point, and wherein the first center point and the second center point are disposable along the transverse axis such that the first sink is located closer to the working edge than the second sink when the dual-sink assembly is installed in the diagonal corner cabinet, the second sink being disposable between the first sink and the rear corner point such that the second length accommodates a convergence of the first rear edge and the second rear edge toward the rear corner point;

wherein aligning the first sink with the second sink comprises offsetting a first lip of the first sink an offset length from a second lip of the second sink, relative to the transverse axis, to accommodate at least a portion of a faucet or a soap dispenser for installation on the countertop within an area defined by the offset length and the second width; and coupling the second sink to the first sink by welding.

10. The method of claim 9, wherein the first sink is formed from a first material, the second sink is formed from a second material that is the same as or different from the first material, and the countertop is formed from a third material that is different from the first material and the second material.

11. The method of claim 9, wherein aligning the first sink with the second sink comprises offsetting a first wall of the first basin an offset width, along the transverse axis, from a second wall of the second basin.

12. The method of claim 11, wherein the offset width is between 2 and 4 inches.

13. The method of claim 11, wherein the offset width is based on a yield strength of a material from which the countertop is formed.

14. The method of claim 9, wherein the first depth is greater than the second depth.

15. The method of claim 9, wherein the dual-sink assembly is a drop-in sink assembly, the first sink is a first single bowl drop-in sink comprising a first lip surrounding the first basin, and the second sink is a second single bowl drop-in sink comprising a second lip surrounding the second basin, and wherein the first lip and the second lip are configured to form fluid-tight seals against a work surface of the countertop when the dual-sink assembly is installed in the diagonal corner cabinet.

16. The method of claim 9, wherein the dual-sink assembly is an undermount sink assembly, the first sink is a first single bowl undermount sink comprising a first lip surrounding the first basin, and the second sink is a second single bowl undermount sink comprising a second lip surrounding the second basin, and wherein the first lip and the second lip are configured to form fluid-tight seals against an underside of the countertop when the dual-sink assembly is installed in the diagonal corner cabinet.

* * * * *